US008255228B2

(12) United States Patent
Hilpert et al.

(10) Patent No.: US 8,255,228 B2
(45) Date of Patent: Aug. 28, 2012

(54) EFFICIENT USE OF PHASE INFORMATION IN AUDIO ENCODING AND DECODING

(75) Inventors: Johannes Hilpert, Nuremberg (DE); Bernhard Grill, Lauf (DE); Matthias Neusinger, Rohr (DE); Julien Robilliard, Nuremberg (DE); Maria Luis-Valero, Erlangen (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 13/004,225

(22) Filed: Jan. 11, 2011

(65) Prior Publication Data

US 2011/0173005 A1 Jul. 14, 2011

Related U.S. Application Data

(63) Continuation of application No. PCT/EP2009/004719, filed on Jun. 30, 2009.

(60) Provisional application No. 61/079,838, filed on Jul. 11, 2008.

(30) Foreign Application Priority Data

Aug. 13, 2008 (EP) ..... 08014468

(51) Int. Cl.
*G10L 19/00* (2006.01)

(52) U.S. Cl. ..... 704/500; 704/200; 704/201; 704/216; 704/217; 704/218; 704/501

(58) Field of Classification Search ..... 704/200–201, 704/216–218, 500–501
See application file for complete search history.

(56) References Cited

U.S. PATENT DOCUMENTS

| | | | | |
|---|---|---|---|---|
| 6,260,010 | B1 * | 7/2001 | Gao et al. | 704/230 |
| 8,000,960 | B2 * | 8/2011 | Chen et al. | 704/219 |
| 2007/0140499 | A1 * | 6/2007 | Davis | 381/23 |
| 2008/0046252 | A1 * | 2/2008 | Zopf et al. | 704/501 |
| 2010/0034394 | A1 * | 2/2010 | Moon et al. | 381/17 |
| 2011/0257968 | A1 * | 10/2011 | Kim et al. | 704/230 |

FOREIGN PATENT DOCUMENTS

| | | | |
|---|---|---|---|
| EP | 1914723 | A2 | 4/2008 |
| WO | WO 2004/008806 | A1 | 1/2004 |
| WO | WO 2005/031704 | A1 | 4/2005 |

* cited by examiner

*Primary Examiner* — Douglas Godbold
(74) *Attorney, Agent, or Firm* — Michael A. Glenn; Glenn Patent Group

(57) ABSTRACT

An efficient encoded representation of a first and a second input audio signal can be derived using correlation information indicating a correlation between the first and the second input audio signals, when a signal characterization information, indicating at least a first or a second, different characteristic of the input audio signal is additionally considered. Phase information indicating a phase relation between the first and the second input audio signals is derived, when the input audio signals have the first characteristic. The phase information and a correlation measure are included into the encoded representation when the input audio signals have the first characteristic, and only the correlation information is included into the encoded representation when the input audio signals have the second characteristic.

30 Claims, 12 Drawing Sheets

200

EFFICIENT USE OF PHASE INFORMATION IN AUDIO ENCODING AND DECODING

CROSS-REFERENCE TO RELATED APPLICATIONS

This application is a continuation of copending International Application No. PCT/EP2009/004719, filed Jun. 30, 2009, which is incorporated herein by reference in its entirety, and additionally claims priority from European Application No. EP 08014468.6, filed Aug. 13, 2008, and U.S. Patent Application No. 61/079,838, filed Jul. 11, 2008, which are all incorporated herein by reference in their entirety.

BACKGROUND OF THE INVENTION

The present invention relates to audio encoding and audio decoding, in particular to an encoding and decoding scheme, selectively extracting and/or transmitting phase information, when reconstruction of such information is perceptually relevant.

Recent parametric multi-channel coding-schemes like binaural cue coding (BCC), parametric stereo (PS) or MPEG surround (MPS) use a compact parametric representation of the humans auditory system's cues for spatial perception. This allows for a rate efficient representation of an audio signal having two or more audio channels. To this end, an encoder performs a down-mix from M-input channels to N-output channels and transmits the extracted cues together with the down-mix signal. The cues are furthermore quantized according to the principles of human perception, that is, information which is not audible or distinguishable by the human auditory system may be deleted or coarsely quantized.

As the downmix-signal is a "generic" audio signal, the bandwidth consumed by such an encoded representation of an original audio signal may be further decreased by compacting the down-mix signal or the channels of the downmix signal using single channel audio compressors. Various types of those single channel audio compressors will be summarized as core coders within the following paragraphs.

Typical cues used to describe the spatial interrelation between two or more audio channels are interchannel level differences (ILD) parametrizing level relations between input channels, interchannel cross correlations/coherences (ICC) parametrizing the statistical dependency between input channels and interchannel time/phase differences (ITD or IPD) parametrizing the time or phase difference between similar signal segments of input channels.

To maintain a high perceptual quality of the signals represented by a down-mix and the previously described cues, individual cues are normally calculated for different frequency bands. That is, for a given time segment of the signal, multiple cues parametrizing the same property are transmitted, each cue-parameter representing a predetermined frequency band of the signal.

The cues may be calculated time- and frequency dependent on a scale close to the human frequency resolution. Whenever multi-channel audio signals are represented, a corresponding decoder performs an upmix from M to N channels based on the transmitted spatial cues and the downmix transmitted signals (the transmitted downmix therefore often being called the carrier signal).

Generally, a resulting upmix channel may be described as a level- and phase weighted version of the transmitted downmix. The decorrelation derived while encoding the signals may be synthesized by mixing and weighting the transmitted downmix signal (the "dry" signal) with a decorrelated signal (the "wet" signal) derived from the downmix signal as indicated by the transmitted correlation parameters (ICC). The upmixed channels then have a similar correlation with respect to each other than the original channels had. A decorrelated signal (i.e. a signal having a cross correlation coefficient close to zero when cross-correlated with the transmitted signal) may be produced by feeding the downmix to a chain of filters, as for example, all-pass filters and delay lines. However, further ways of deriving a decorrelated signal may be used.

Apparently, in a particular implementation of the above encoding/decoding scheme, a trade-off between the transmitted bitrate (ideally being as low as possible) and the achievable quality (ideally being as high as possible) of the encoded signal, has to be performed.

It may, therefore, be decided to not transmit a full set of spatial cues, but to omit transmission of one particular parameter. This decision may additionally be influenced by the selection of an appropriate upmix. An appropriate upmix could, for example, reproduce a spatial cue not transmitted on the average. That is, at least for a long-term segment of the full bandwidth signal, the average spatial property is preserved.

In particular, not all of the parametric multi-channel schemes make use of interchannel time or interchannel phase differences, thus avoiding the respective calculation and synthesis. Schemes like MPEG surround rely on synthesis of ILDs and ICCs only. The interchannel phase-differences are implicitly approximated by the decorrelation synthesis, which mixes two representations of the decorrelated signal to the transmitted downmix signal, wherein the two representations have a relative phase shift of 180°. A transmission of IPDs is omitted, thus reducing the amount of parametric information, at the same time, accepting a degradation in reproduction quality.

SUMMARY

According to an embodiment, an audio encoder for generating an encoded representation of a first and a second input audio signal may have: a correlation estimator adapted to derive correlation information indicating a correlation between the first and the second input audio signals; a signal characteristic estimator adapted to derive signal characterization information, the signal characterization information indicating a first or a second, different characteristic of the input audio signal; a phase estimator adapted to derive phase information when the input audio signals have the first characteristic, the phase information indicating a phase relation between the first and the second input audio signals; and an output interface, adapted to include the phase information and a correlation measure into the encoded representation when the input audio signals have the first characteristic; or the correlation information into the encoded representation when the input audio signals have the second characteristic, wherein the phase information is not included when the input audio signals have the second characteristic.

According to another embodiment, an audio encoder for generating an encoded representation of a first and a second input audio signal may have: a spatial parameter estimator adapted to derive an ICC-parameter or an ILD-parameter, the ICC-parameter indicating a correlation between the first and the second input audio signals, the ILD-parameter indicating a level relation between the first and the second input audio signals; a phase estimator adapted to derive a phase information, the phase information indicating a phase relation between the first and the second input audio signals; an output operation mode decider adapted to indicate a first output mode when the phase relation indicates a phase difference between the first and the second input audio signals which is greater than a predetermined threshold, or a second output mode, when the phase difference is smaller than the predetermined threshold; and an output interface, adapted to include the ICC- or the ILD-parameter and the phase information into the encoded representation in the first output mode; and the ICC- and the ILD-parameter without the phase information into the encoded representation in the second output mode.

According to another embodiment, an audio decoder for generating a first and a second audio channel using an encoded representation of an audio signal, the encoded representation having a downmix audio signal, first and second correlation information indicating a correlation between a first and a second original audio channel used to generate the downmix audio signal, the first correlation information having the information for a first time segment of the downmix signal and the second correlation information having the information for a second, different time segment, the encoded representation further having phase information for the first and the second time segment, the phase information indicating a phase relation between the first and the second original audio channels, may have: an upmixer adapted to derive a first intermediate audio signal using the downmix audio signal and the first correlation information, the first intermediate audio signal corresponding to the first time segment and having a first and a second audio channel; and a second intermediate audio signal using the downmix audio signal and the second correlation information, the second intermediate audio signal corresponding to the second time segment and having a first and a second audio channel; and an intermediate signal postprocessor adapted to derive a postprocessed intermediate audio signal for the first time segment using the first intermediate audio signal and the phase information, wherein the intermediate signal postprocessor is adapted to add an additional phase shift indicated by the phase relation to at least one of the first or the second audio channels of the first intermediate audio signal; and a signal combiner adapted to generate the first and the second audio channel by combining the postprocessed intermediate audio signal and the second intermediate audio signal.

According to another embodiment, a method for generating an encoded representation of a first and a second input audio signal may have the steps of: deriving correlation information indicating a correlation between the first and the second input audio signals; deriving signal characterization information, the signal characterization information indicating a first or a second, different characteristic of the input audio signals; deriving phase information when the input audio signals have the first characteristic, the phase information indicating a phase relation between the first and the second input audio signals; and including the phase information and a correlation measure into the encoded representation when the input audio signals have the first characteristic; or including the correlation information into the encoded representation when the input audio signals have a second characteristic, wherein the phase information is not included when the input audio signals have the second characteristic.

According to another embodiment, a method for generating an encoded representation of a first and a second input audio signal may have the steps of: deriving an ICC-parameter or an ILD-parameter, the ICC-parameter indicating a correlation between the first and the second input audio signals, the ILD-parameter indicating a level relation between the first and the second input audio signals; deriving a phase information, the phase information indicating a phase relation between the first and the second input audio signals; indicating a first output mode when the phase relation indicates a phase difference between the first and the second input audio signals which is bigger than a predetermined threshold, or indicating a second output mode when the phase difference is smaller than the predetermined threshold; and including the ICC or the ILD parameter and the phase relation into the encoded representation in the first output mode; or including the ICC or the ILD parameter without the phase relation into the encoded representation in the second output mode.

According to another embodiment, a method for deriving a first and a second audio channel using an encoded representation of an audio signal, the encoded representation having a downmix audio signal, first and second correlation information indicating a correlation between a first and a second original audio channel used to generate the downmix audio signal, the first correlation information having the information for a first time segment of the downmix signal and the second correlation information having the information for a second, different time segment, the encoded representation further having phase information for the first and the second time segment, the phase information indicating a phase relation between the first and the second original audio channels, may have the steps of: deriving a first intermediate audio signal using the downmix audio signal and the first correlation information, the first intermediate audio signal corresponding to the first time segment and having a first and a second audio channel; deriving a second intermediate audio signal using the downmix audio signal and the second correlation information, the second intermediate audio signal corresponding to the second time segment and having a first and the second audio channel; deriving a post processed intermediate signal for the first time segment, using the first intermediate audio signal and the phase information, wherein the post processed intermediate signal is derived by adding an additional phase shift indicated by the phase relation to at least one of the first or the second audio channels of the first intermediate signal; and combining the post processed intermediate signal and the second intermediate audio signal to derive the first and the second audio channels.

According to another embodiment, an encoded representation of an audio signal may have: a downmix signal generated using a first and a second original audio channel; a first correlation information indicating a correlation between the first and the second original audio channels within a first time segment; a second correlation information indicating a correlation between the first and the second original audio channels within a second time segment; and phase information indicating a phase relation between the first and the second original audio channels for the first time segment, wherein the phase information is the only phase information included in the representation for the first and for the second time segments.

Another embodiment may have a computer program having a program code for performing, when running on a computer, any of the inventive methods.

One embodiment of the present invention achieves this goal by using a phase estimator, which derives a phase information indicating a phase relation between a first and a second input audio signal, when a phase shift between the input audio signals exceeds a predetermined threshold. An associated output interface, which includes the spatial parameters and a downmix signal into the encoded representation of the input audio signals, does only include the derived phase information, when the transmission of phase information is, from a perceptional point of view, necessitated.

To do this, the determination of the phase information may be performed continuously and only the decision, whether the phase information is to be included or not, may be taken based on the threshold. The threshold could, for example, describe a maximum allowable phase shift, for which additional phase information processing is not necessitated to achieve an acceptable quality of the reconstructed signal.

Alternatively, the phase shift between the input audio signals may be derived independently from the actual generation of the phase information, such that a decent phase analysis to derive the phase information is only taking place when the phase threshold is exceeded.

Alternatively, a spatial output mode decider may be implemented, which receives the continuously generated phase information, and which steers the output interface to include the phase information only when a phase information condition is met, that is, for example, when the phase difference between the input signals exceeds a predetermined threshold.

That is to say, the output interface predominantly includes the ICC and ILD parameters as well as the downmix signal into the encoded representation of the input audio signals only. On occurrence of a signal having particular signal characteristics, the determined phase information is additionally included, such that the signal reconstructed using the encoded representation may be reconstructed with higher quality. However, this may be achieved by only a minimum amount of additional transmitted information, since the phase information is indeed only transmitted for those signal parts, which are critical.

This allows, on the one hand, for a high quality reconstruction and, on the other hand, for a low bitrate implementation.

A further embodiment of the invention analyzes the signal to derive a signal characterization information, the signal characterization information distinguishing between input audio signals having different signal types or characteristics. This could, for example, be the different characteristics of speech and of music signals. The phase estimator may only be necessitated, when the input audio signals have a first characteristic, whereas, when the input audio signals have a second characteristic, phase estimation might be obsolete. The output interface does therefore only include the phase information, when a signal is encoded which necessitates phase synthesis in order to provide an acceptable quality of the reconstructed signal.

Other spatial cues, such as, for example, the correlation information (for example ICC parameters) are permanently included in the encoded representation, since their presence may be important for both signal types or signal characteristics. This may, for example, also be true for the interchannel level difference, which essentially describes an energy relation between two reconstructed channels.

In a further embodiment, the phase estimation may be performed based on other spatial cues, such as on the correlation ICC between the first and the second input audio signal. This may become feasible when the characterization information is present, which includes some additional constraints on the signal characteristics. Then, the ICC parameter may be used to extract, apart from statistical information, also phase information.

According to a further embodiment, the phase information may be included extremely bit efficient in that only one phase-switch is implemented, signalling the application of a phase shift of predetermined size. Nonetheless, the rough reconstruction of the phase relation in reproduction may be enough for certain signal types, as elaborated in more detail below. In further embodiments the phase information may be signalled in a much higher resolution (for example, 10 or 20 different phase shifts) or even as a continuous parameter, giving possible relative phase angles between −180° and +180°.

When the signal characteristic is known, phase information may only be transmitted for a small number of frequency bands, which may be much smaller than the number of frequency bands used for the derivation of the ICC and/or ILD parameters. When it is for example known that the audio input signals have a speech characteristic, only one single phase information may be necessitated for the whole bandwidth. In a further embodiment, a single phase information may be derived for a frequency range between, say, 100 Hz and 5 kHz, since it is assumed that the signal energy of a speaker is mainly distributed in this frequency range. A common phase information parameter for the full bandwidth may, for example, be feasible when a phase shift exceeds more than 90 degrees or more than 60 degrees.

When the signal characteristic is known, the phase information may furthermore directly be derived from already existent ICC parameters or correlation parameters, by applying a threshold criterion to said parameters. For example, when the ICC parameter is smaller than −0.1, it may be concluded that this correlation parameter corresponds to a fixed phase shift, as the speech characteristic of the input audio signals constrains other parameters as described in more detail below.

In a further embodiment of the present invention, an ICC parameter (correlation parameter) derived from the signal is furthermore modified or postprocessed, when the phase information is included into the bitstream. This utilizes the fact, that an ICC (correlation) parameter may actually comprise information about two characteristics, namely about the statistical dependence between the input audio signals and about a phase shift between those signals. When additional phase information is transmitted, the correlation parameter may therefore be modified, such that phase and correlation are, separately, considered as best as possible while reconstructing the signal.

In a fully backwards compatible scenario, such correlation modification may also be performed by an embodiment of an inventive decoder. It could be activated, when the decoder receives additional phase information.

To allow for such a perceptually superior reconstruction, embodiments of inventive audio decoders may comprise an additional signal processor operating on the intermediate signals generated by an internal upmixer of the audio decoder. The upmixer does, for example, receive the downmix signal and all spatial cues other than the phase information (ICC and ILD). The upmixer derives a first and a second intermediate audio signal, having signal properties as described by the spatial cues. To this end, the generation of an additional reverberation (decorrelated) signal may be foreseen in order to mix decorrelated signal portions (wet signals) and the transmitted downmix channel (dry signal).

However, the intermediate signal post processor does apply an additional phase shift to at least one of the intermediate signals, when phase information is received by the audio decoder. That is, the intermediate signal post processor is only operative when the additional phase information is transmitted. That is, embodiments of inventive audio decoders are fully compatible with a conventional audio decoder.

The processing in some embodiments of decoders may, as well as on the encoder side, be performed in a time and frequency selective manner. That is, a consecutive series of neighbouring time slices having multiple frequency bands may be processed. Therefore, some embodiments of audio encoders incorporate a signal combiner in order to combine the generated intermediate audio signals and post processed intermediate audio signals, such that the encoder outputs time-continuous audio signal That is, for a first frame (time segment), the signal combiner may use the intermediate audio signals derived by the upmixer and, for a second frame, the signal combiner may use the post processed intermediate signal, as it is derived by the intermediate signal post processor. Further to introducing a phase shift, it is, of course, also possible to implement a more sophisticated signal processing into the intermediate signal post processor.

Alternatively, or additionally, embodiments of audio decoders may comprise a correlation information processor, such as to post-process a received correlation information ICC, when phase information is additionally received. The post processed correlation information may then be used by a conventional upmixer, to generate the intermediate audio signals, such that, in combination with the phase shift introduced by the signal post processor, a naturally sounding reproduction of the audio signals may be achieved.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
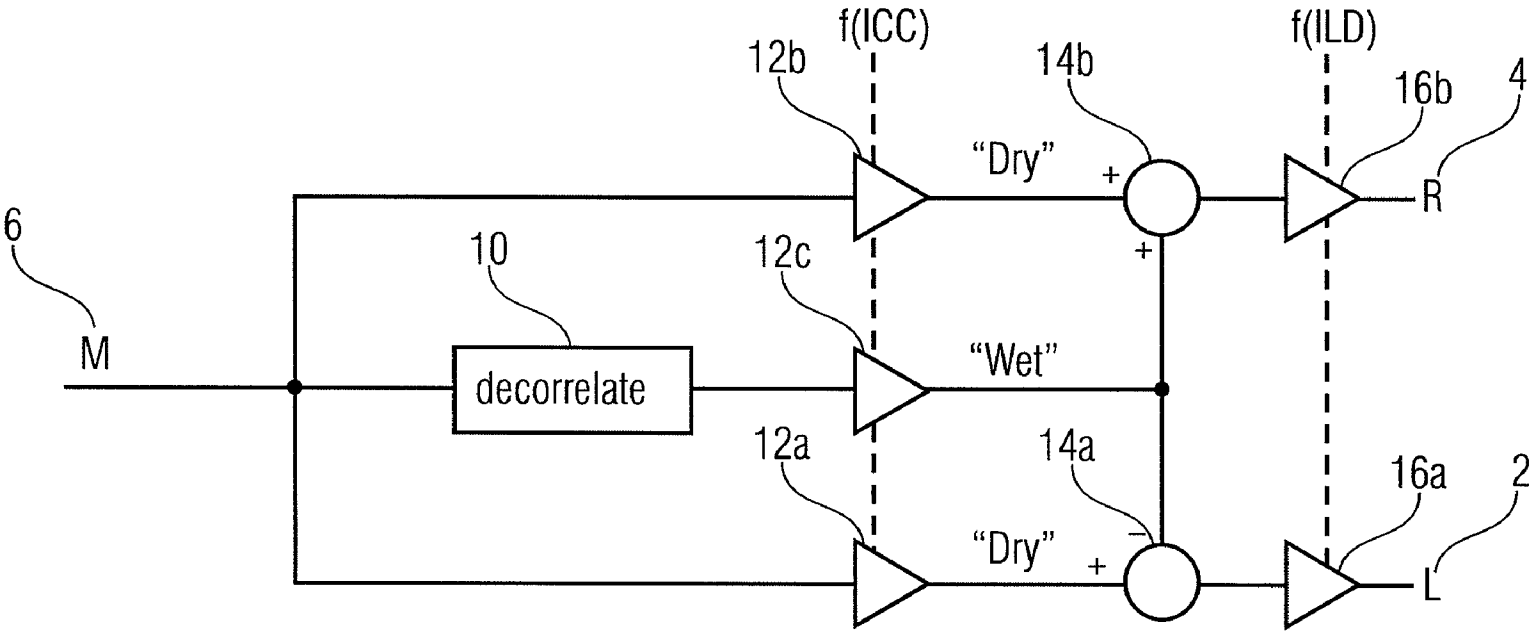
FIG. 1 shows an upmixer generating two output signals from a downmix signal.

FIG. 1 shows an upmixer as it may be used within an embodiment of a decoder to generate a first intermediate audio signal 2 and a second intermediate audio signal 4, using a downmix signal 6. Furthermore, an additional interchannel correlation information and an interchannel level difference information is used as steering parameters of amplifiers to control the upmix.

The upmixer comprises a decorrelator 10, three correlation related amplifiers 12*a* to 12*c*, a first mixing node 14*a*, a second mixing note 14*b*, as well as first and second level related amplifiers 16*a* and 16*b*. The downmix audio signal 6 is a mono signal, which is distributed to the decorrelator 10 as well as to the input of decorrelation related amplifiers 12*a* and 12*b*. The decorrelator 10 creates, using the downmix audio signal 6, a decorrelated version of same by means of a decorrelation algorithm. The decorrelated audio channel (decorrelated signal) is input into the third of the correlation related amplifiers 12*c*. It may be noted that signal components of the upmixer which only comprise samples of the downmix audio signals are often also called "dry" signals, whereas signal components only comprising samples of the decorrelated signal are often called "wet" signals.

The ICC related amplifiers 12*a* to 12*c* scale the wet and the dry signal components, according to a scaling rule depending on the transmitted ICC parameter. Basically, the energy of those signals is adjusted prior to a summation of the dry and wet signal components by the summation nodes 14*a* and 14*b*. To this end, the output of the correlation related amplifier 12*a* is provided to a first input of the first summation node 14*a* and the output of the correlation related amplifier 12*b* is provided to a first input of summation node 14*b*. The output of the correlation related amplifier 12*c* associated to the wet signal is provided to a second input of the first summation node 14*a* as well as to a second input of the second summation node 14*b*. However, as indicated in FIG. 1, the sign of the wet signal at the summation nodes differs, in that it is input into the first summation node 14*a* with negative sign, whereas the wet signal with its original sign is input into the second summation node 14*b*. That is, the decorrelated signal is mixed with the first dry signal component with its original phase, whereas it is mixed with the second dry signal component with an inverted phase, i.e. with an phaseshift of 180°.

The energy ratio was, as already explained, preceedingly adjusted in dependence of the correlation parameter, such that the signals output from the summation nodes 14*a* and 14*b* have a correlation similar to correlation of the originally encoded signals (which is parametrized by the transmitted ICC parameter). Finally, an energy relation between the first channel 2 and the second channel 4 is adjusted, using the energy related amplifiers 16*a* and 16*b*. The energy relation is parametrized by the ILD parameter, such that both amplifiers are steered by a function depending on the ILD parameter.

That is, the so generated left and right channels 2 and 4 have a statistical dependence being similar to the statistical dependence of the originally encoded signals.

However, the contributions to the generated first (left) and second (right) output signals 2 and 4 originating directly from the transmitted downmix audio signal 6 have identical phases.

Figure 4:
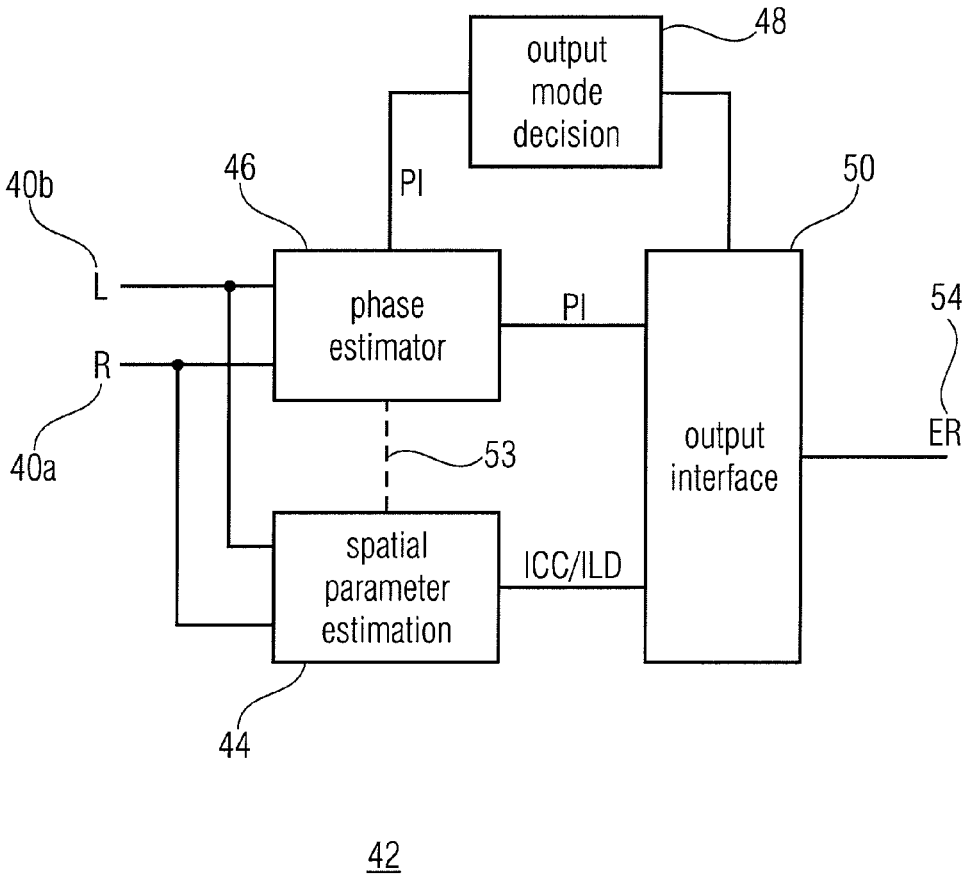
FIG. 4 shows an embodiment of an audio encoder.

Although FIG. 1 assumes a broadband implementation of the upmix, further implementations may perform the upmix individually for multiple parallel frequency bands, such that the upmixer of FIG. 4 may operate on a bandwidth limited representation of the original signal. The reconstructed signal with the full band with could then be gained by adding all bandwidth limited output signals in a final synthesis mixture.

Figure 2:
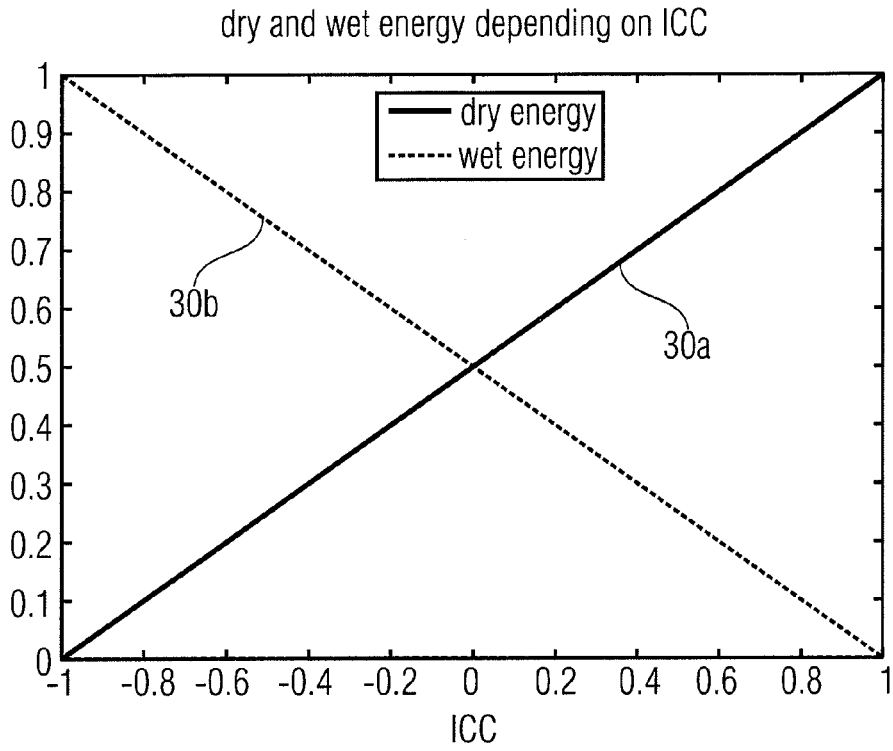
FIG. 2 shows an example for a use of ICC parameters by the upmixer of FIG. 1.

FIG. 2 shows an example of a ICC parameter dependent function used to steer the correlation related amplifiers 12*a* to 12C. Using that function and appropriately deriving a ICC parameter from original channels to be encoded, the phaseshift between the originally encoded signals may be coarsely reproduced (on the average). For this discussion, an understanding of the generation of the transmitted ICC parameter is essential. The basis for this discussion may be a complex inter-channel coherence parameter, derived between two corresponding signal segments of two input audio signals to be encoded, which is defined as follows:

$$ICC_{complex} = \frac{\sum_k \sum_l X_1(k, l) X_2^*(k, l)}{\sqrt{\sum_k \sum_l |X_1(k, l)|^2 \sum_k \sum_l |X_2(k, l)|^2}}.$$

In the preceding equation, l indexes the number of samples within the signal segment processed, whereas the optional index k denotes one of several subbands, which may, according to some specific embodiments, be represented by one single ICC parameter. In other words, $X_1$ and $X_2$ are the complex-valued subband samples of the two channels, k is the subband index and l is the time index.

The complex-valued subband samples may be derived by feeding the originally sampled input signals into a QMF-filterbank, deriving for example 64 subbands, wherein the samples within each of the subbands are represented by a complexe-valued number. Calculating a complex cross correlation using the previous formula, two corresponding signal segments are characterized by one complex-valued parameter, the parameter $ICC_{complex}$, which has the following properties:

Its length $|ICC_{complex}|$ represents the coherence of the two signals. The longer the vector, the more statistical dependence is between the two signals.

That is, whenever the length or the absolute value of $ICC_{complex}$ equals 1, both signals are, apart from one global scaling factor, identical. However, they may have a relative phase difference, which is then given by the phase angle of $ICC_{complex}$. In that case, the angle of $ICC_{complex}$ with respect to the real axis represents the phase angle between the two signals. However, when the derivation of $ICC_{complex}$ is performed using more than one subband (that is, k>=2), the phase angle is consequently an average angle for all the processed parameter bands.

In other words, when the two signals are statistically strongly dependent ($|ICC_{complex}|\approx 1$), the real part Re $\{ICC_{complex}\}$ is approximately the cosine of the phase angle, and thus the cosine of the phase difference between the signals.

When the absolute value of $ICC_{complex}$ is significantly lower than 1, the angle Θ between the vector $ICC_{complex}$ and the real axis can no longer be interpreted to be a phase angle between identical signals. It is then rather a best matching phase between statistically fairly independent signals.

Figure 3:
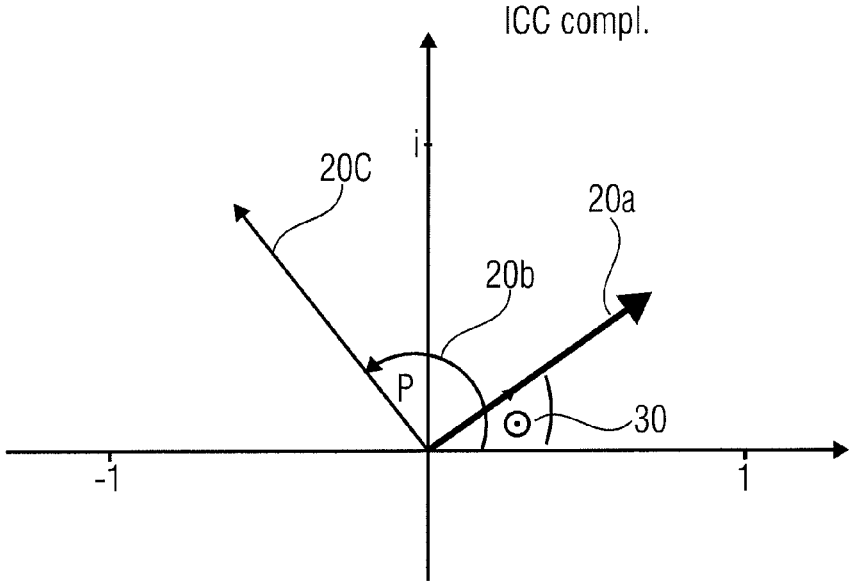
FIG. 3 shows examples for signal characteristics of audio input signals to be encoded.

FIG. 3 gives three examples 20*a*, 20*b* and 20*c* of possible vectors $ICC_{complex}$. The absolute value (length) of vector 20*a* is close to unity, meaning that the two signals represented by the vector 20*a* are nearly the same but phase shifted with respect to each other. In other words, both signals are highly coherent. In that case, the phase angle 30 (Θ) directly corresponds to a phase shift between the almost identical signals.

However, if an evaluation of $ICC_{complex}$ results in vector 20*b*, the meaning of the phase angle Θ is no longer that well determined. Since the complex vector 20*b* has an absolute value significantly lower than 1, both analyzed signal portions or signals are statistically fairly independent. That is, the signal within the observed time segments have no common shape. Still, the phase angle 30 represents somewhat of a phase shift corresponding to the best match of both signals. However, when the signals are incoherent, a common phase shift between the two signals is hardly of any significance.

Vector 20*c*, again, has an absolute value close to unity, such that its phase angle 32 (Φ) may again be unambiguously identified as a phase difference between two similar signals. Furthermore, it is apparent that a phase shift greater than 90° corresponds to a real part of the vector $ICC_{complex}$, which is smaller than 0.

In audio coding schemes focusing on the correct construction of the statistical dependence of two or more coded signals, a possible upmix procedure to create a first and a second output channel from a transmitted downmix channel is illustrated in FIG. 1.

As an ICC dependent function to control the correlation related amplifiers 20*a*-20*c*, the function illustrated in FIG. 2 is often used, to allow for a smooth transition from totally correlated to total decorrelated signals, without introducing any discontinuities. FIG. 2 shows how the signal energies are distributed between the dry signal components (by steering amplifiers 12*a* and 12*b*) and the wet signal component (by steering amplifier 12*c*). To achieve this, the real part of ICC complex is transmitted as a measure for the length of $ICC_{complex}$ and thus for the similarity between signals.

In FIG. 2, the x-axis gives the value of the transmitted ICC parameter and the y-axis gives the amount of energy of the dry signal (solid line 30*a*) and of the wet signal (dashed line 30*b*) mixed together by the summation nodes 14*a* and 14*b* of the upmixer. That is, when the signals are perfectly correlated (same signal shape, same phase), the ICC parameter transmitted will be unity. Therefore, the upmixer distributes the received downmix audio signal 6 to the outputs, without adding any wet signal parts. As the downmix audio signal is essentially the sum of the original channels encoded, the reproduction is correct with respect to the phase and to the correlation.

If, however, the signals are anti-correlated (phase=180°, same signal shape), the transmitted ICC parameter is −1. Therefore, the reconstructed signal will comprise no signal portions of the dry signal, but only signal components of the wet signal. As the wet signal portion is added to the first audio channel and substracted from the second audio channel generated, the phase shift between the signals is correctly reconstructed to be 180°. However, the signal comprises no dry signal portions at all. This is unfortunate, since the dry signal actually comprises the whole direct information transmitted to the decoder.

Therefore, the signal quality of the reconstructed signal may be decreased. However, the decrease may be dependent on the signal type encoded, i.e., on the signal characteristic of the underlying signal. In general terms, the correlated signals provided by decorrelator 10 have a reverberation-like sound characteristic. That is, for example, the audible distortion from only using the decorrelated signal is rather low for music signals as compared to speech signals, where a reconstruction from a reverberated-audio signal leads to an unnatural sounding.

In summarizing, the previously described decoding scheme does only coarsely approximate the phase properties, since these are, at best, restored on the average. This is an extremely coarse approximation, since it is only achieved by varying the energy of the signal added, wherein the signal portions added have a relative phase difference of 180°. For signals that are clearly decorrelated or even anti-correlated ($ICC \leqq 0$), a significant amount of decorrelated signal is necessitated to restore this decorrelation, i.e., the statistical independence between the signals. As, generally, the decorrelated signal as output of allpass filters has a "reverb-like" sound, the overall achievable quality is strongly degraded.

As already mentioned, for some signal types, the restoration of the phase relation may be less important, but for other signal types, the correct restoration may be perceptually relevant. In particular, the reconstruction of an original phase relation may be necessitated, when a phase information derived from the signals satisfies certain perceptually motivated phase reconstruction criteria.

Several embodiments of the present invention do, therefore, include phase information into a encoded representation of audio signals, when certain phase properties are fullfilled. That is, phase information is only occasionally transmitted, when the benefit (in a rate-distortion estimation) is significant. Moreover, the transmitted phase information may be coarsely quantized, such that only an insignificant amount of additional bit rate is necessitated.

Given the transmitted phase information, it is possible to reconstruct the signal with a correct phase relation between the dry signal components, that is, between the signal components directly derived from the original signals, which are, therefore, perceptually highly relevant.

If, for example, signals are encoded with an $ICC_{complex}$-vector 20*c*, the transmitted ICC parameter (the real part of $ICC_{complex}$) is approximately −0.4. That is, in the upmix, more than 50% of the energy will be derived from the decorrelated signal. However, as an audible amount of energy is still originating from the downmix audio channel, the phase relation between the signal components originating from the downmix audio channel is still important, since audible. That is, it may be desirable to approximate the phase relation between the dry signal portions of the reconstructed signal more closely.

Therefore, additional phase information is transmitted, once it is determined that a phase shift between the original audio channels is greater than a predetermined threshold. Examples for such a threshold may be 60°, 90° or 120°, depending on the specific implementation. Depending on the threshold, the phase relation may be transmitted with high resolution, i.e., one of multiple predetermined phase shifts is signaled, or a continuously varying phase angle is transmitted.

In some embodiments of the present invention, only a single phase shift indicator or phase information is transmitted, indicating that the phase of the reconstructed signals shall be shifted by a predetermined phase angle. According to one embodiment, this phase shift applies only when the ICC parameter is within a predetermined negative range. This range could, for example, be the range from −1 to −0.3 or from −0.8 to −0.3 dependent on that phase threshold criterion. That is, one single bit of phase information may be necessitated.

When the real part of $ICC_{complex}$ is positive, the phase relation between the reconstructed signals are, on the average, approximated correctly by the upmixer of FIG. 1 due to the phase-identical processing of the dry signal components.

If, however, the transmitted ICC parameter is below 0, the phase shift of the original signals is, on the average, greater than 90°. At the same time, still audible signal portions of the dry signal are used by the upmixer. Therefore, in an area starting from ICC=0 to, say, ICC approximately −0.6, a fixed phase shift (corresponding for example to the phase shift corresponding to the middle of the previously introduced interval) may provide for a significantly increased perceptual quality of the reconstructed signal, at the cost of only one single transmitted bit. When the ICC parameter proceeds to ever smaller values, for example, lower than −0.6, only small amounts of signal energy in the first and second output channels 2 and 4 originate from the dry signal component. Therefore, restoring the correct phase properties between those perceptually less relevant signal portions may again be skipped, since the dry signal portions are hardly audible at all.

FIG. 4 shows one embodiment of an inventive encoder for generating an encoded representation of a first input audio signal 40*a* and a second input audio signal 40*b*. The audio encoder 42 comprises a spatial parameter estimator 44, a phase estimator 46, an output operation mode decider 48 and an output interface 50.

The first and second input audio signals 40*a* and 40*b* are distributed to the spatial parameter estimator 44 as well as to the phase estimator 46. The spatial parameter estimator is adapted to derive spatial parameters, indicating a signal characteristic of the two signals with respect to each other, such as for example an ICC parameter and an ILD parameter. The estimated parameters are provided to the output interface 50.

The phase estimator 46 is adapted to derive phase information of the two input audio signals 40*a* and 40*b*. Such phase information could, for example, be a phase shift between the two signals. The phase shift could, for example, be directly estimated by performing a phase analysis of the two input audio signals 40*a* and 40*b* directly. In a further alternative embodiment, the ICC parameters derived by the spatial parameter estimator 44 may be provided to the phase estimator via an optional signal line 52. The phase estimator 46 could then perform the phase difference determination using the ICC parameters anyway derived. This may lead to an implementation with lower complexity, as compared to an embodiment with full phase analysis of the two audio input signals.

The phase information derived is provided to the output operation mode decider 48, which is able to switch the output interface 50 between a first output mode and a second output mode. The phase information derived is provided to the output interface 50, which creates an encoded representation of the first and the second input audio signals 40*a* and 40*b* by including specific subsets of the generated ICC, ILD or PI (phase information) parameters into the encoded representation. In the first mode of operation, the output interface 50 includes the ICC, the ILD and the phase information PI into the encoded representation 54. In the second mode of operation, the output interface 50 includes only the ICC and the ILD parameter into the encoded representation 54.

The output mode decider 48 decides for the first output mode, when the phase information indicates a phase difference between the first and the second audio signals 40*a* and 40*b*, which is greater than a predetermined threshold. The phase difference could, for example, be determined by performing a complete phase analysis of the signal. This could, for example, be performed by shifting the input audio signals with respect to each other and by calculating the cross-correlation for each of the signal shifts. The cross-correlation with the highest value corresponds to the phaseshift.

In an alternative embodiment, the phase information is estimated from the ICC parameter. A significant phase difference is assumed, when the ICC parameter (the real part of $ICC_{complex}$) is below a predetermined threshold. Possible phase shifts for the detection could, for example, be a phase shift bigger than 60°, 90° or 120°. To the contrary, a criterion for the ICC parameter could be a threshold of 0.3, 0 or −0.3.

The phase information introduced into the representation could, for example, be a single bit indicating a predetermined phase shift. Alternatively, the transmitted phase information could be more precise by transmitting phase shifts in a finer quantization, up to a continuous representation of a phase shift.

Furthermore, the audio encoder could operate on a band limited copy of the input audio signals, such that several audio encoders 43 of FIG. 4 are implemented in parallel, each audio encoder operating on a bandwidth filtered version of an original broadband signal.

Figure 5:
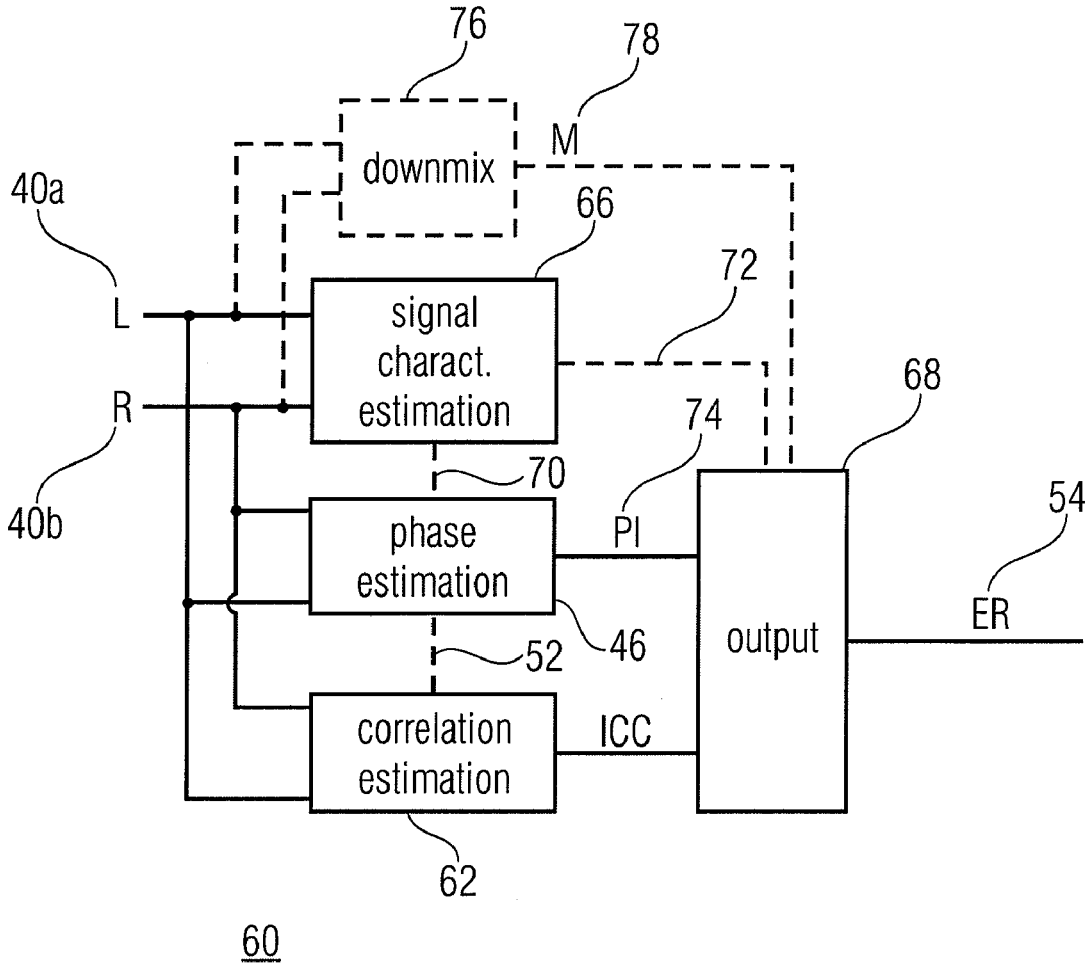
FIG. 5 shows a further embodiment of an audio encoder.

FIG. 5 shows a further embodiment of an inventive audio encoder, comprising a correlation estimator 62, a phase estimator 46, a signal characteristic estimator 66 and an output interface 68. The phase estimator 46 corresponds to the phase estimator introduced in FIG. 4. A further discussion of the properties of the phase estimator is therefore omitted to avoid unnecessary redundancies. Generally, components having the same or similar functionalities are given the same references. The first input audio signal 40*a* and the second input audio signal 40*b* are distributed to the signal characteristic estimator 66, the correlation estimator 62 and the phase estimator 46.

The signal characteristic estimator is adapted to derive signal characterization information, which indicates a first or a second different characteristic of the input audio signal. For example, a speech signal could be detected as a first characteristic and a music signal could be detected as a second signal characterization. The additional signal characteristic information can be used to determine the need for the transmission of phase information or, additionally, to interpret the correlation parameter in terms of a phase relation.

In one embodiment, the signal characterization estimator 66 is a signal classifier, used to derive the information, whether the current extract of the audio signal, i.e. of the first and second input audio channels 40*a* and 40*b*, is speech-like or non-speech. Dependent on the derived signal characteristic, phase estimation by the phase estimator 46 could be switched on and off via an optional control link 70. Alternatively, phase estimation could be performed all the time, while the output interface is steered via an optional second control link 72, such as to include the phase information 74 only, when the first characteristic of the input audio signal, i.e. for example, the speech-characteristic, is detected.

To the contrary, ICC-determination is performed all the time, such as to provide a correlation parameter necessitated for an upmix of an encoded signal.

A further embodiment of an audio encoder may, optionally, comprise a downmixer 76, adapted to derive a Downmix audio signal 78, which could, optionally be included into the encoded representation 54 provided by the audio encoder 60. In an alternative embodiment, the phase information could be based on an analysis of the correlation information ICC, as already discussed for the embodiment of FIG. 4. To this end, the output of the correlation estimator 62 may be provided to the phase estimator 46 via an optional signal line 52.

Such determination could, for example, be based on $ICC_{complex}$ according to the following considerations, when the signal is discriminated between being a speech-signal and a music-signal.

When it is known from the signal characteristic information 66, that the signal is a speech-signal, one could evaluate $ICC_{complex}$, $$ICC_{complex} = \frac{\sum_k \sum_l X_1(k, l) X_2^*(k, l)}{\sqrt{\sum_k \sum_l |X_1(k, l)|^2 \sum_k \sum_l |X_2(k, l)|^2}}$$

according to the following considerations. When a speech-signal is determined, it may be concluded that the signal received by the human auditory signal is strongly correlated, since the origin of a speech-signal is point-like. Therefore, the absolute value of $ICC_{complex}$ is close to 1. Therefore, the phase angle Θ (IPD) of FIG. 3 can be estimated by using only the information on the real part of $ICC_{complex}$ according to the following formula, without even valuating the complex vector $ICC_{complex}$:

$$Re\{ICC_{complex}\} = \cos(IPD)$$

Phase information may be gained based on the real part of $ICC_{complex}$, which could be determined without ever calculating the imaginary part of $ICC_{complex}$.

In short, one could conclude $$|ICC_{complex}| \approx 1 \rightarrow Re\{ICC_{complex}\} = \cos(IPD)$$

In the above equation, please note that cos(IPD) corresponds to cos(Θ) of FIG. 3.

The necessity to perform a phase-synthesis on the decoder side could, more generally, also be derived according to the following considerations:

Coherence (abs($ICC_{complex}$) significantly >0, Correlation (Real($ICC_{complex}$)) significantly <1, or Phase angle (arg($ICC_{complex}$)) significantly different from 0.

Please note that these are general criteria, wherein at the presence of speech, it is implicitly assumed that abs ($ICC_{complex}$) is significantly greater than 0.

Figure 6:
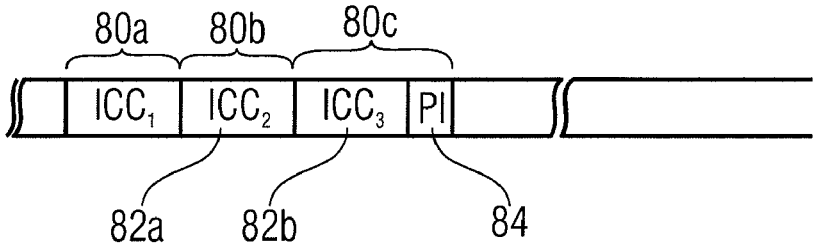
FIG. 6 shows an example for an encoded representation of an audio signal generated by one of the encoders of FIGS. 4 and 5.

FIG. 6 gives an example of an encoded representation derived by the encoder 60 of FIG. 5. Corresponding to a time segment 80*a* and to a first time segment 80*b*, the encoded representation only comprises correlation information, wherein for the second time segment 80*c*, the encoded representation generated by the output interface 68 comprises correlation information as well as phase information PI. In short, an encoded representation generated by the audio encoder may be characterized in that it comprises a downmix signal (not shown for simplicity), which is generated using a first and a second original output channel. The encoded representation further comprises a first correlation information 82*a* indicating a correlation between the first and the second original audio channels within a first time segment 80*b*. The representation does furthermore comprise a second correlation information 82*b* indicating a decorrelation between the first and the second audio channels within a second time segment 80*c* and first phase information 84, indicating a phase relation between the first and the second original audio channel for the second time segment, wherein no phase information is included for the first time segment 80*b*. Please note that for the ease of illustration, FIG. 6 only illustrates the side information, whereas the downmix channel which is also transmitted, is not shown.

Figure 7:
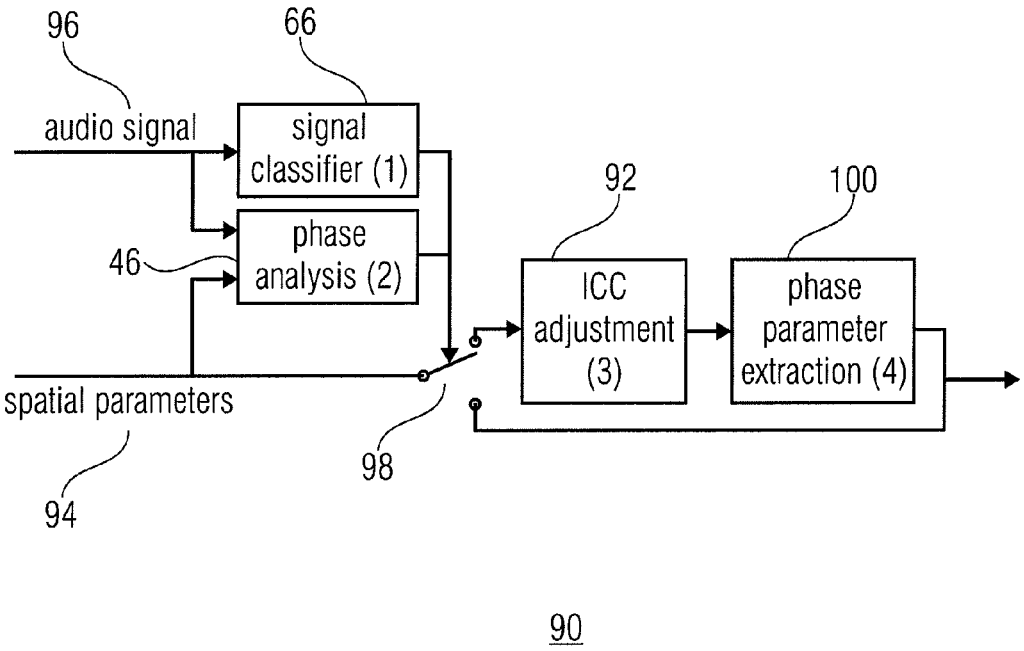
FIG. 7 shows a further embodiment of an encoder.

FIG. 7 schematically shows a further embodiment of the present invention, in which an audio encoder 90 furthermore comprises a correlation information modifier 92. The illustration of FIG. 7 assumes, that the spatial parameter extraction of, for example, the parameters ICC and ILD, has already been performed, such that the spatial parameters 94 are provided together with the audio signal 96. The audio encoder 90 furthermore comprises a signal characteristic estimator 66 and a phase estimator 46, operating as indicated above. Dependent on the result of the signal classification and/or the phase analysis, phase parameters are extracted and submitted according to a first mode of operation, indicated by the upper signal path. Alternatively, a switch 98, which is steered by the signal classification and/or the phase analysis may activate a second mode of operation, where the provided spatial parameters 94 are transmitted without modification.

However, when the first mode of operation necessitating the transmission of phase information is chosen, the correlation information modifier 92 derives a correlation measure from the received ICC-parameters, which is transmitted instead of the ICC-parameters. The correlation measure is chosen such that it is greater than the correlation information, when a relative phase shift between the first and the second input audio signals is determined, and when the audio signal is classified to be a speech-signal. Additionally, phase parameters are extracted and transmitted by phase parameter extractor 100.

The optional ICC adjustment or the determination of a correlation measure, which is to be submitted instead of the originally derived ICC-parameter, may have the effect of an even better perceptual quality, since it accounts for the fact that for ICC s smaller than 0, the reconstructed signal would comprise only less than 50% of the dry signal, which are actually the only signals derived directly from the original audio signals. That is, although one knows that the audio signals can only differ significantly by a phase shift, the reconstruction provides a signal, which is dominated by the decorrelated signal (the wet signal). When the ICC-parameter (the real part of $ICC_{complex}$) is increased by the correlation information modifier, the upmix will automatically use more signal energy from the dry signal, such using more of the "genuine" audio information, such that the reproduced signal is even closer to the original, when the necessity of a phase reproduction is derived.

In other words, the transmitted ICC-parameters are modified in a way that the decoder upmix adds less decorrelated signal. One possible modification of the ICC parameter is to use the interchannel coherence (absolute value of $ICC_{complex}$) instead of the interchannel cross-correlation usually used as the ICC-parameter. Interchannel cross-correlation is defined as:

$$ICC=Re\{ICC_{complex}\},$$

and depends on the phase relation of the channels. Interchannel coherence, however, is independent of the phase relation and defined as follows:

$$ICC=|ICC_{complex}|.$$

The interchannel phase difference is calculated and transmitted to the decoder together with the remaining spatial side information. The representation can be very coarse in quantization of the actual phase values and may furthermore have a coarse frequency resolution, wherein even a broadband phase information may be beneficial, as it will be apparent from the embodiment of FIG. 8.

The phase difference may be derived from the complex interchannel relations as follows:

$$IPD=arg(ICC_{complex}).$$

If the phase information is included in the bit stream, i.e. into the encoded representation 54, a decoder's decorrelation synthesis may use the modified ICC-parameters (the correlation measures) to produce an upmix signal with reduced reverberation.

If, for example, the signal classifier discriminates between speech and music signals, a decision whether the phase synthesis is necessitated, could be taken according to the following rules, once a predominant speech-characteristic of the signal is determined.

First of all, a broad-band indication value or phase shift indicator may be derived, for several of the parameter bands, used to generate the ICC and ILD parameters. That is, for example, a frequency range predominantly populated by speech signals could be evaluated (for example between 100 Hz and 2 KHz). One possible evaluation would be to calculate the mean correlation within this frequency range, based on the already derived ICC-parameters of the frequency bands. If it turns out that this mean correlation is smaller than a predetermined threshold, the signal may be assumed to be out of phase and a phase shift is triggered. Furthermore, multiple thresholds may be used to signal different phase shifts, depending on the desired granularity of the phase reconstruction. Possible threshold values could, for example, be 0, −0.3 or −0.5.

Figure 8:
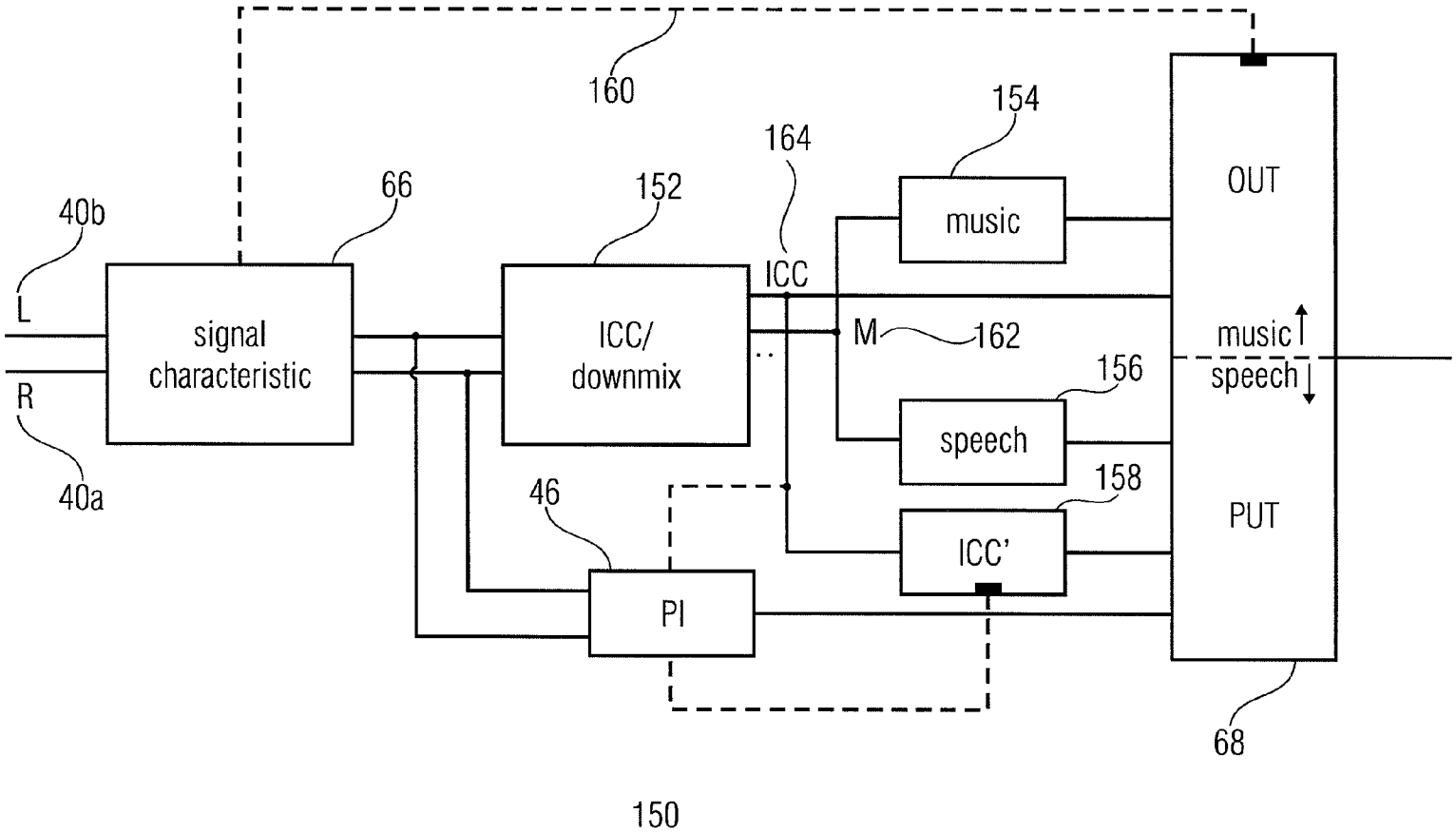
FIG. 8 shows a further embodiment of an encoder for speech/music encoding.

FIG. 8 shows a further embodiment of the present invention, in which the encoder 150 is operative to encode speech and music signals. The first and second input audio signals 40*a* and 40*b* are provided to the encoder 150, which comprises a signal characteristic estimator 66, a phase estimator 46, a downmixer 152, a music core-coder 154, a speech core-coder 156 and a correlation information modifier 158. The signal characteristic estimator 66? is adapted to discriminate between a speech characteristic as first signal characteristic and a music characteristic as a second signal characteristic. Via control link 160, the signal characteristic estimator 66 is operative to steer the output interface 68, depending on the signal characteristic derived.

The phase estimator estimates phase information, either directly from the input audio channels 40*a* and 40*b* or from the ICC-parameter derived by the downmixer 152. The downmixer creates a downmix audio channel M (162) and correlation information ICC (164). According to the previously described embodiments, the phase information estimator 46 may alternatively derive the phase information directly from the provided ICC-parameters 164. The downmix audio channel 162 can be provided to the music core coder 154 as well as to the speech core coder 156, both of which are connected to the output interface 68 to provide the encoded representation of the audio downmix channel. The correlation information 164 is, on the one hand, directly provided to the output interface 68. On the other hand, it is provided to the input of a correlation information modifier 158, adapted to modify the provided correlation information and to provide the so derived correlation measure to the output interface 68.

The output interface includes different subsets of parameters into the decoded representation, depending on the signal characteristic estimated by the signal characteristic estimator 66. In a first (speech) mode of operation, the output interface 68 includes the encoded representation of the downmix audio channel 106 encoded by the speech core-coder 156, as well as phase information PI derived from the phase estimator 46 and the correlation measure. The correlation measure may either be the correlation parameter ICC derived by the downmixer 152, or, alternatively, a correlation measure modified by the correlation information modifier 158. To this end, the correlation information modifier 158 may be steered and/or activated by the phase information estimator 46.

In a music mode of operation, the output interface includes the downmix audio channel 162 as encoded by the music core-coder 154 and the correlation information ICC as derived from the downmixer 152.

It goes without saying that the inclusion of the different parameter subsets may be implemented different as in the particular embodiment described above. For example, the music and/or speech coders may be deactivated, until a activation signal switches them into the signal path, depending on the signal characteristic derived from the signal characteristic estimator 66.

Figure 9:
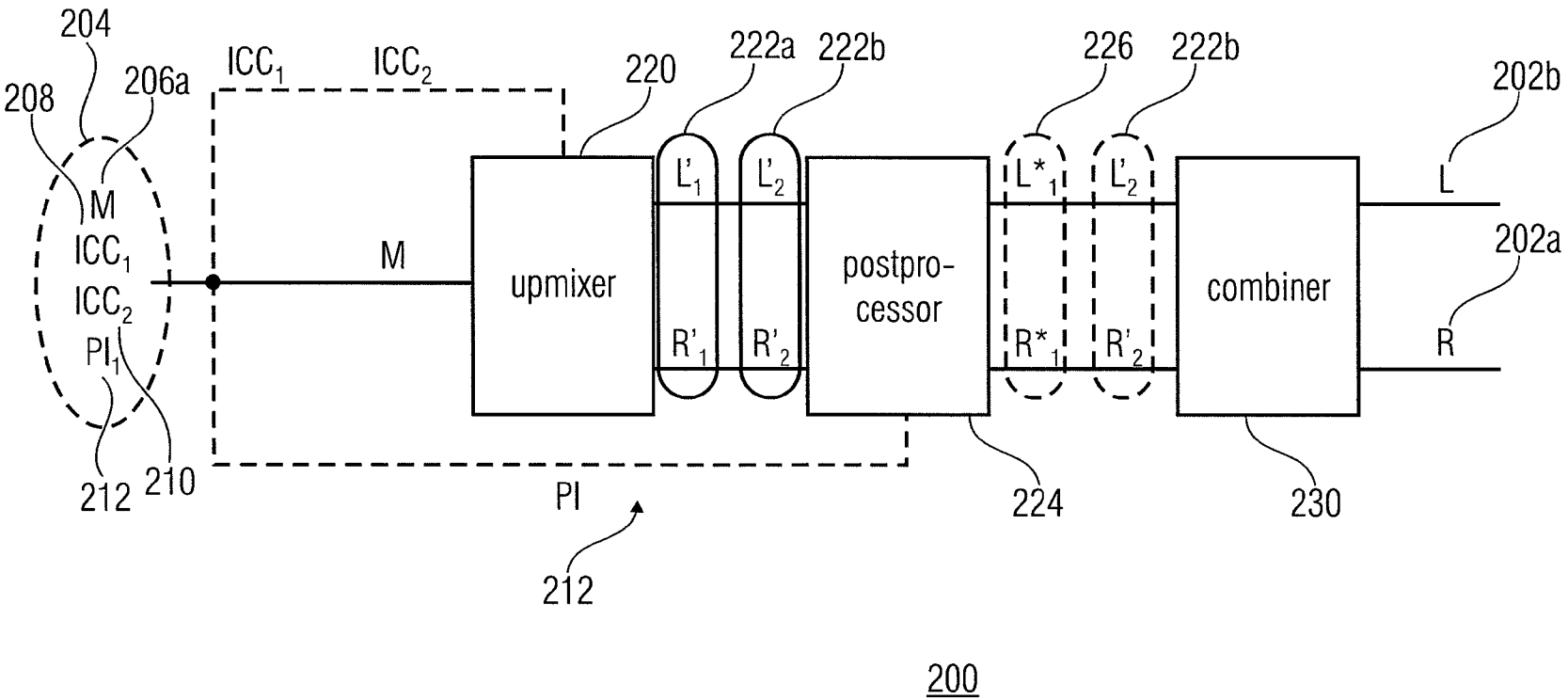
FIG. 9 shows an embodiment of a decoder.

FIG. 9 shows an embodiment of a decoder according to the present invention. The audio decoder 200 is adapted to derive a first audio channel 202*a* and a second audio channel 202*b* from an encoded representation 204, the encoded representation 204 comprising a downmix audio signal 206*a*, first correlation information 208 for the first time segment of the downmix signal and second correlation information 210 for a second time segment of the downmix signal, wherein phase information 212 is only included for the first or second time segment.

A demultiplexer, which is not shown, demultiplexes the individual components of the encoded representation 204 and provides the first and second correlation information together with the Downmix audio signal 206*a* to an upmixer 220. The upmixer 220 could, for example, be the upmixer described in FIG. 1. However, different upmixers with different internal upmixing algorithms may be used. Generally, the upmixer is adapted to derive a first intermediate audio signal 222*a* for the first time segment, using the first correlation information 208 and the downmix audio signal 206*a*, as well as a second intermediate audio signal 222*b*, corresponding to the second time segment, using the second correlation information 210 and the downmix audio signal 206*a*.

In other words, the first time segment is reconstructed using decorrelation information $ICC_1$ and the second time segment is reconstructed using $ICC_2$. The first and second intermediate signals 222*a* and 222*b* are provided to an intermediate signal postprocessor 224, adapted to derive a postprocessed intermediate signal 226 for the first time segment using the corresponding phase information 212. To this end, the intermediate signal postprocessor 224 receives the phase information 212, together with the intermediate signals generated by the upmixer 220. The intermediate signal postprocessor 224 is adapted to add a phase shift to at least one of the audio channels of the intermediate audio signals, when phase information corresponding to the particular audio signal is present.

That is, the intermediate signal postprocessor 224 adds a phase shift to the first intermediate audio signal 222*a*, wherein the intermediate postprocessor does not add any phase shift to the intermediate audio signal 222*b*. The intermediate signal postprocessor 224 outputs a postprocessed intermediate signal 226 instead of the first intermediate audio signal and an unaltered second intermediate audio signal 222*b*.

The audio decoder 200 further comprises a signal combiner 230, to combine the signals output from the intermediate signal postprocessor 224, and to thus derive the first and second audio channels 202*a* and 202*b* generated by the audio decoder 200.

In one particular embodiment, the signal combiner concatenates the signals as output from the intermediate signal postprocessor, to finally derive an audio signal for the first and second time segments. In a further embodiment, the signal combiner may implement some cross fading, such as to derive the first and second audio signals 202*a* and 202*b* by fading between the signals provided from the intermediate signal postprocessor. Of course, further implementations of the signal combiners 230 are feasible.

Using an embodiment of an inventive decoder as illustrated in FIG. 9 provides for the flexibility to add a additional phase shift, as it may be signaled by an encoder signal, or decode the signal in a backwards compatible manner.

Figure 10:
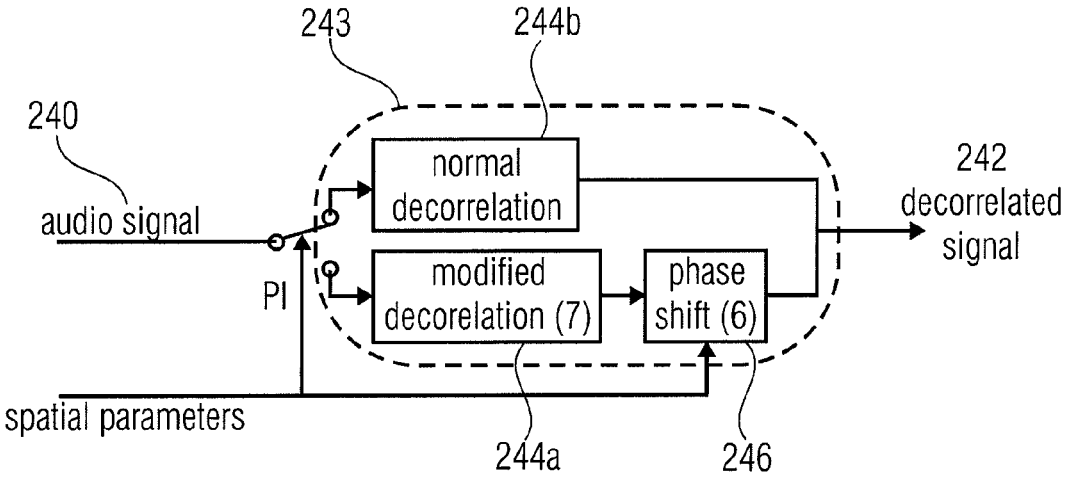
FIG. 10 shows a further embodiment of a decoder.

FIG. 10 shows a further embodiment of the present invention, in which the audio decoder comprises a decorrelation circuit 243, capable of operating according to a first decorrelation rule and according to a second decorrelation rule, depending on the transmitted phase information. According to the embodiment of FIG. 10, the decorrelation rule, according to which a decorrelated signal 242 is derived from the transmitted downmix audio channel 240 can be switched, wherein the switching depends on the existing phase information.

In a first mode, in which phase information is transmitted, a first decorrelation rule is used in order to derive the decorrelated signal 242. In a second mode, in which phase information is not received, a second decorrelation rule is used, creating a decorrelated signal, which is more decorrelated than the signal created using the first decorrelation rule.

That is, when phase synthesis is necessitated, a decorrelated signal may be derived, which is not as highly decorrelated as the signal used when no phase synthesis is necessitated. That is, a decoder may then use a decorrelated signal, which is more similar to the dry signal, as such automatically creating a signal having more dry-signal components in the upmix. This is achieved by making the decorrelated signal more similar to the dry signal.

In a further embodiment, an optional phase shifter 246 may be applied to the decorrelated signal generated for a reconstruction with phase synthesis. This provides a closer reconstruction of the phase properties of the reconstructed signal, by providing a decorrelated signal already having the correct phase relation with respect to the dry signal.

Figure 11:
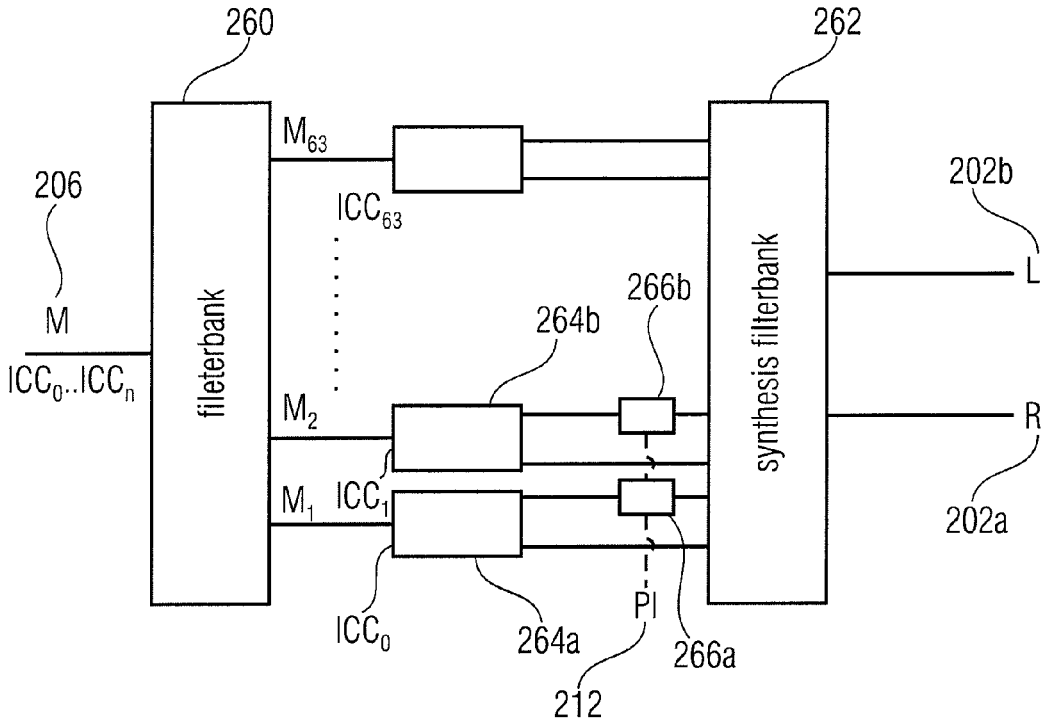
FIG. 11 shows a further embodiment of a decoder.

FIG. 11 shows a further embodiment of an inventive audio decoder, comprising an analysis filter bank 260 and a synthesis filter bank 262. The decoder receives a downmix audio signal 206 together with the related ICC-parameters ($ICC_0 \ldots ICC_n$). However, in FIG. 11, the different ICC-parameters are not only associated to different time segments but also to different frequency bands of the audio signal. That is, each time segment process has a full set of associated ICC-parameters ($ICC_0 \ldots ICC_n$).

As the processing is performed in a frequency selective manner, the analysis filterbank 260 derives 64 subband representations of the transmitted downmix audio signal 206. That is, 64 bandwidth limited signals (in the filterbank representation) are derived, each signal being associated with one ICC-parameter. Alternatively, several bandwidth limited signals may share a common ICC parameter. Each of the subband representations is processed by an upmixer 264*a*, 264*b*, . . . . Each of the upmixers could, for example, be an upmixer in accordance with the embodiment of FIG. 1.

Therefore, for each bandwidth limited representation, a first a the second audio channel (both bandwidth limited) are created. At least one of the so created audio channels per subband is input into an intermediate audio signal postprocessor 266*a*, 266*b* . . . , as, for example, the intermediate audio signal postprocessor described in FIG. 9. According to the embodiment of FIG. 11, the intermediate audio signal postprocessors 266*a*, 266*b*, . . . are steered by the same, common, phase information 212. That is, an identical phase shift is applied to each subband signal, before the subband signals are synthesized by the synthesis filterbank 262 to become the first and second audio channels 202*a* and 202*b* output by the decoder.

A phase synthesis may thus be performed, necessitating only one additional common phase information to be transmitted. In the embodiment of FIG. 11, the correct restoration of the phase properties of the original signal can, therefore, be performed without a reasonable increase in bit rate.

According to further embodiments, the number of subbands, for which the common phase information 212 is used, is signal dependent. Therefore, the phase information may only be evaluated for subbands, for which an increase in perceptual quality can be achieved, when a corresponding phase shift is applied. This may further increase the perceptual quality of the decoded signal.

Figure 12:
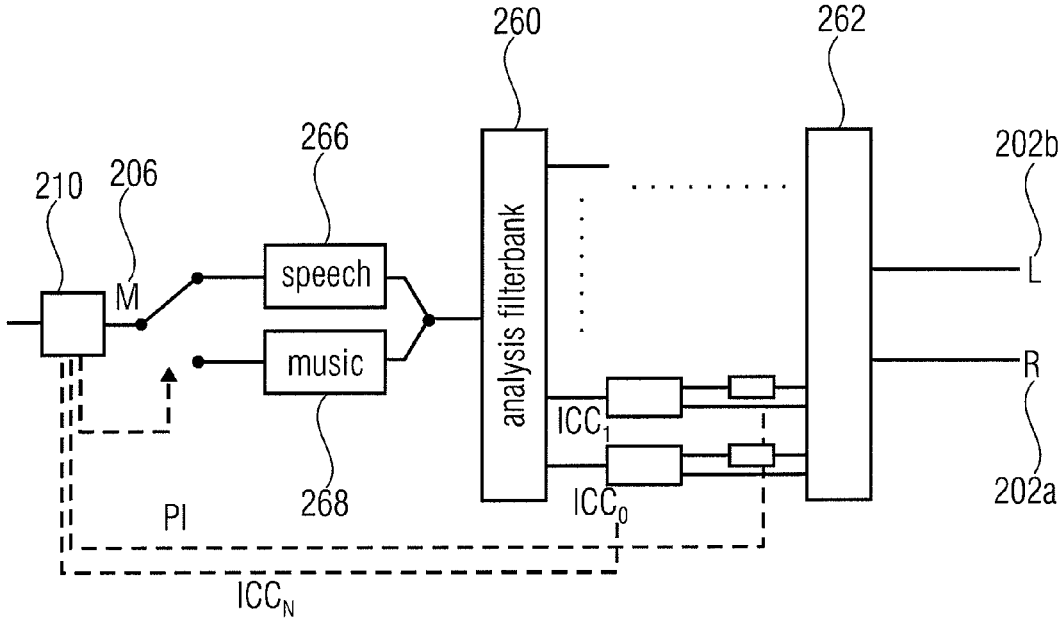
FIG. 12 shows an embodiment of a speech/music decoder.

FIG. 12 shows a further embodiment of an audio decoder, adapted to decode an encoded representation of an original audio signal, which could be both, a speech signal or a music signal. That is, either a signal characterization information is transmitted within the encoded representation, indicating which signal characteristic is transmitted, or, the signal characteristic may implicitly be derived, depending on the presence of phase information in the bit stream. To this end, the presence of phase information would indicate a speech characteristic of the audio signal. The transmitted downmix audio signal 206 is, depending on the signal characteristic, either decoded by a speech decoder 266 or by a music decoder 268.

The further processing is performed as illustrated and explained in FIG. 11. For the further implementation details, reference is therefore made to the explanation of FIG. 11.

Figure 13:
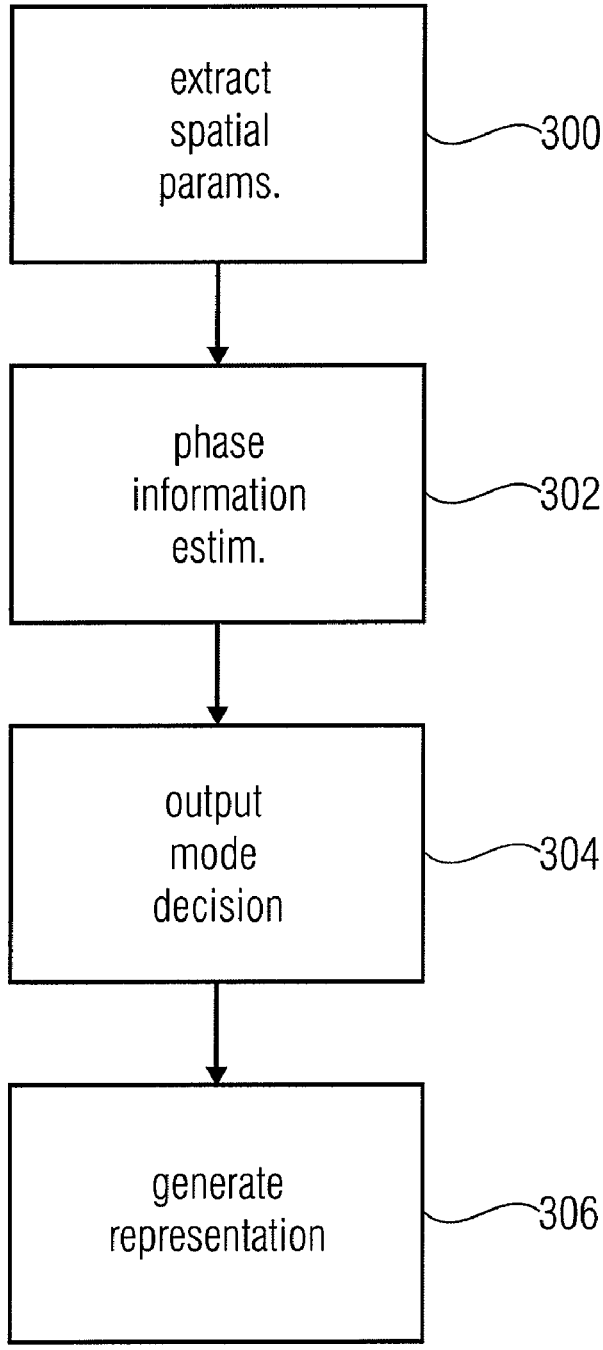
FIG. 13 shows an embodiment of a method for encoding.

FIG. 13 illustrates an embodiment of an inventive method for generating an encoded representation of a first and a second input audio signal. In a spatial parameter extraction step 300, an ICC- and an ILD-parameter is derived from the first and the second input audio signals. In a phase estimation step 302, phase information indicating a phase relation between the first and the second input audio signals is derived. In a mode decision 304, a first output mode is selected, when the phase relation indicates a phase difference between the first and the second input audio signal, which is greater than a predetermined threshold and a second output mode is selected, when the phase difference is smaller than the threshold. In a representation generation step 306 the ICC-parameter, the ILD-parameter and the phase information is included in the encoded representation in the first output mode, and the ICC- and the ILD-parameters without the phase relation are included into the encoded representation in the second output mode.

Figure 14:
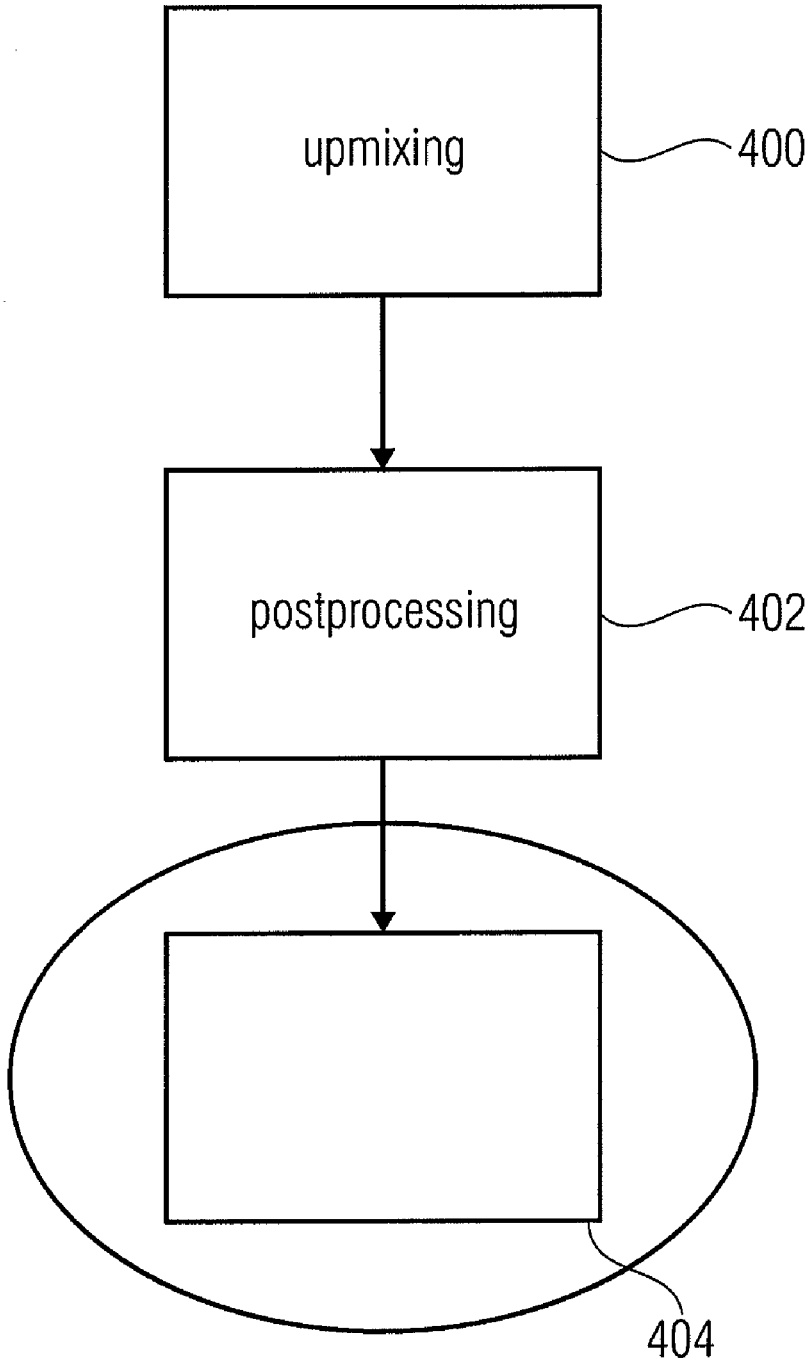
FIG. 14 shows an embodiment of a method for decoding.

FIG. 14 shows an embodiment of a method for generating a first and a second audio channel using an encoded representation of an audio signal, the encoded representation comprising a downmix audio signal, first and second correlation information indicating a correlation between a first and a second original audio channel used to generate the downmix signal, the first correlation information having the information for a first time segment of the downmix signal and the second correlation information having the information for a second, different time segment, and phase information, the phase information indicating a phase relation between the first and the second original audio channels for the first time segment.

In an upmixing step 400, a first intermediate audio signal is derived using the downmix signal and the first correlation information, the first intermediate audio signal corresponding to the first time segment and comprising a first and a second audio channel. In the upmixing step 400, a second intermediate audio signal using the downmix audio signal and the second correlation information is also derived, the second intermediate audio signal corresponding to the second time segment and comprising a first and a second audio channel.

In a postprocessing step 402, a postprocessed intermediate signal is derived for the first time segment, using the first intermediate audio signal, wherein an additional phase shift indicated by the phase relation is added to at least one of the first or the second audio channels of the first intermediate audio signal.

In a signal combination step 404, the first and the second audio channels are generated, using the postprocessed intermediate signal and the second intermediate audio signal.

Depending on certain implementation requirements of the inventive methods, the inventive methods can be implemented in hardware or in software. The implementation can be performed using a digital storage medium, in particular a disk, DVD or a CD having electronically readable control signals stored thereon, which cooperate with a programmable computer system such that the inventive methods are performed. Generally, the present invention is, therefore, a computer program product with a program code stored on a machine readable carrier, the program code being operative for performing the inventive methods when the computer program product runs on a computer. In other words, the inventive methods are, therefore, a computer program having a program code for performing at least one of the inventive methods when the computer program runs on a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Audio encoder for generating an encoded representation of a first and a second input audio signal, comprising:

a correlation estimator adapted to derive correlation information indicating a correlation between the first and the second input audio signals;

a signal characteristic estimator adapted to derive signal characterization information, the signal characterization information indicating a first or a second, different characteristic of the input audio signal;

a phase estimator adapted to derive phase information when the input audio signals comprise the first characteristic, the phase information indicating a phase relation between the first and the second input audio signals; and an output interface, adapted to include the phase information and a correlation measure into the encoded representation when the input audio signals have the first characteristic; or the correlation information into the encoded representation when the input audio signals comprise the second characteristic, wherein the phase information is not comprised when the input audio signals have the second characteristic, wherein the correlation estimator, the signal characteristic estimator, the phase estimator or the output interface comprises a hardware implementation.

2. The audio encoder of claim 1, wherein the first signal characteristic indicated by the signal estimator is a speech characteristic; and the second signal characteristic indicated by the signal estimator is a music characteristic.

3. The audio encoder of claim 1, wherein the phase estimator is adapted to derive the phase information using the correlation information.

4. The audio encoder of claim 3, wherein the correlation estimator is adapted to generate an ICC-parameter as the decorrelation information, the ICC-parameter represented by a real part of a complex cross-correlation $ICC_{complex}$ of sampled signal segments of the first and the second input audio signal, each signal segment being represented by 1 sample values X(1), wherein the ICC-parameter can be described by the following formula:

$$ICC = \mathrm{Re}\left\{\frac{\sum_{e} X_1(l)X_2^*(l)}{\sqrt{\sum_{e}|X_1(l)|^2\sum_{e}|X_2(l)|^2}}\right\},$$

and wherein the output interface is adapted to comprise the phase information into the encoded representation, when the correlation information is smaller than a predetermined threshold.

5. The audio encoder of claim 4, wherein the predetermined threshold is equal to or smaller than 0.3.

6. The audio encoder of claim 4, wherein the predetermined threshold for the correlation information corresponds to a phase shift of more than 90°.

7. The audio encoder of claim 1, wherein the phase information indicates a phase shift between the first and the second input audio signals.

8. The audio encoder of claim 1, wherein the correlation estimator is adapted to derive multiple correlation parameters as the correlation information, each correlation parameter being related to a corresponding subband of the first and the second input audio signals, and wherein the phase estimator is adapted to derive a phase information indicating the phase relation between the first and the second input audio signals for at least two of the subbands corresponding to the correlation parameters.

9. The audio encoder of claim 1, further comprising a correlation information modifier adapted to derive the correlation measure such that the correlation measure indicates a higher correlation than the correlation information; and wherein the output interface is adapted to comprise the correlation measure instead of the correlation information.

10. The audio encoder of claim 9, wherein the correlation information modifier is adapted to use the absolute value of a complex cross-correlation $ICC_{complex}$ of two sampled signal segments of the first and the second input audio signal as the correlation measure ICC, each signal segment being represented by 1 complex value sample values X(1), the correlation measure ICC being described by the following formula:

$$ICC = \left| \frac{\sum_{e} X_1(l) X_2^*(l)}{\sqrt{\sum_{e} |X_1(l)|^2 \sum_{e} |X_2(l)|^2}} \right|.$$

11. Audio encoder for generating an encoded representation of a first and a second input audio signal, comprising:

a spatial parameter estimator adapted to derive an ICC-parameter or an ILD-parameter, the ICC-parameter indicating a correlation between the first and the second input audio signals, the ILD-parameter indicating a level relation between the first and the second input audio signals;

a phase estimator adapted to derive a phase information, the phase information indicating a phase relation between the first and the second input audio signals;

an output operation mode decider adapted to indicate a first output mode when the phase relation indicates a phase difference between the first and the second input audio signals which is greater than a predetermined threshold, or a second output mode, when the phase difference is smaller than the predetermined threshold; and an output interface, adapted to include the ICC- or the ILD-parameter and the phase information into the encoded representation in the first output mode; and the ICC- and the ILD-parameter without the phase information into the encoded representation in the second output mode, wherein the spatial parameter estimator, the phase estimator, the output operation mode decider or the output interface comprises a hardware implementation.

12. The audio encoder of claim 11, wherein the predetermined threshold corresponds to a phase shift of 60°.

13. The audio encoder of claim 11, wherein the spatial parameter estimator is adapted to derive multiple ICC- or ILD-parameters, each ICC- or ILD-parameter being related to a corresponding subband of a subband representation of the first and the second input audio signals, and wherein the phase estimator is adapted to derive a phase information indicating the phase relation between the first and the second input audio signals for at least two of the subbands of the subband representation.

14. The audio encoder of claim 13, wherein the output interface is adapted to comprise a single phase information parameter into the representation as the phase information, the single phase information parameter indicating the phase relation for a predetermined subgroup of the subbands of the subband representation.

15. The audio encoder of claim 11, wherein the phase relation is represented by a single bit indicating a predetermined phase shift.

16. Audio decoder for generating a first and a second audio channel using an encoded representation of an audio signal comprising:

an upmixer adapted to derive a first intermediate audio signal using a downmix audio signal and a first correlation information, the first intermediate audio signal corresponding to a first time segment and comprising a first and a second audio channel; and a second intermediate audio signal using the downmix audio signal and a second correlation information, the second intermediate audio signal corresponding to a second time segment and comprising a first and a second audio channel; and an intermediate signal postprocessor adapted to derive a postprocessed intermediate audio signal for the first time segment using the first intermediate audio signal and a phase information, wherein the intermediate signal postprocessor is adapted to add an additional phase shift indicated by a phase relation indicated by the phase information to at least one of the first or the second audio channels of the first intermediate audio signal; and a signal combiner adapted to generate the first and the second audio channel by combining the postprocessed intermediate audio signal and the second intermediate audio signal, wherein the upmixer, the intermediate signal postprocessor or the signal combiner comprises a hardware implementation.

17. The audio decoder of claim 16, wherein the upmixer is adapted to use multiple correlation parameters as the correlation information, each correlation parameter corresponding to one of multiple subbands of the first and second original audio signals; and wherein the intermediate signal postprocessor is adapted to add the additional phase shift indicated by the phase relation to at least two of the corresponding subbands of the first intermediate audio signal.

18. The audio decoder of claim 16, further comprising a correlation information processor adapted to derive a correlation measure, the correlation measure indicating a higher correlation than the first correlation; and wherein the upmixer uses the correlation measure instead of the correlation information, when the phase information indicates a phase shift between the first and the second original audio channels, which is higher than a predetermined threshold.

19. The audio decoder according to claim 16, further comprising a decorrelator adapted to derive a decorrelated audio channel from the downmix audio signal according to a first decorrelation rule for the first time segment and according to a second decorrelation rule for the second time segment, wherein the first decorrelation rule creates a less decorrelated audio channel than the second decorrelation rule.

20. The audio decoder of claim 19, wherein the decorrelator further comprises a phase shifter, the phase shifter adapted to apply an additional phase shift to the decorrelated audio channel generated using the first decorrelation rule, the additional phase shift depending on the phase information.

21. Audio decoder of claim 16, wherein the encoded representation comprising the downmix audio signal, the first and second correlation information indicating a correlation between a first and a second original audio channel used to generate the downmix audio signal, the first correlation information comprising the information for the first time segment of the downmix signal and the second correlation information comprising the information for the second, different time segment, the encoded representation further comprising the phase information for the first and the second time segment, the phase information indicating the phase relation between the first and the second original audio channels.

22. Method for generating an encoded representation of a first and a second input audio signal, comprising:

deriving, by a correlation estimator, correlation information indicating a correlation between the first and the second input audio signals;

deriving, by a signal characteristic estimator, signal characterization information, the signal characterization information indicating a first or a second, different characteristic of the input audio signals;

deriving, by a phase estimator, phase information when the input audio signals have the first characteristic, the phase information indicating a phase relation between the first and the second input audio signals; and including, by an output interface, the phase information and a correlation measure into the encoded representation when the input audio signals have the first characteristic; or including, by the output interface, the correlation information into the encoded representation when the input audio signals have a second characteristic, wherein the phase information is not comprised when the input audio signals comprise the second characteristic, wherein the correlation estimator, the signal characteristic estimator, the phase estimator or the output interface comprises a hardware implementation.

23. Method for generating an encoded representation of a first and a second input audio signal, comprising:

deriving, by a spatial parameter estimator, an ICC-parameter or an ILD-parameter, the ICC-parameter indicating a correlation between the first and the second input audio signals, the ILD-parameter indicating a level relation between the first and the second input audio signals;

deriving, by a phase estimator, a phase information, the phase information indicating a phase relation between the first and the second input audio signals;

indicating, by an output operation mode decider, a first output mode when the phase relation indicates a phase difference between the first and the second input audio signals which is bigger than a predetermined threshold, or indicating a second output mode when the phase difference is smaller than the predetermined threshold; and including, by an output interface, the ICC or the ILD parameter and the phase relation into the encoded representation in the first output mode; or including, by the output interface, the ICC or the ILD parameter without the phase relation into the encoded representation in the second output mode, wherein the spatial parameter estimator, the phase estimator, the output operation mode decider or the output interface comprises a hardware implementation.

24. Method for deriving a first and a second audio channel using an encoded representation of an audio signal, comprising:

deriving, by an upmixer, a first intermediate audio signal using a downmix audio signal and first correlation information, the first intermediate audio signal corresponding to a first time segment and comprising a first and a second audio channel;

deriving, by the upmixer, a second intermediate audio signal using the downmix audio signal and a second correlation information, the second intermediate audio signal corresponding to a second time segment and comprising a first and a second audio channel;

deriving, by an intermediate signal postprocessor, a post processed intermediate signal for the first time segment, using the first intermediate audio signal and phase information, wherein the post processed intermediate signal is derived by adding an additional phase shift indicated by a phase relation indicated by the phase information to at least one of the first or the second audio channels of the first intermediate signal; and combining, by a signal combiner, the post processed intermediate signal and the second intermediate audio signal to derive the first and the second audio channels, wherein the upmixer, the intermediate signal postprocessor or the signal combiner comprises a hardware implementation.

25. Method of claim 24, wherein the encoded representation comprising the downmix audio signal, the first and second correlation information indicating a correlation between a first and a second original audio channel used to generate the downmix audio signal, the first correlation information comprising the information for the first time segment of the downmix signal and the second correlation information comprising the information for the second, different time segment, the encoded representation further comprising the phase information for the first and the second time segment, the phase information indicating the phase relation between the first and the second original audio channels.

26. Non-transitory storage medium having stored thereon an encoded representation of an audio signal, comprising:

a downmix signal generated using a first and a second original audio channel;

a first correlation information indicating a correlation between the first and the second original audio channels within a first time segment;

a second correlation information indicating a correlation between the first and the second original audio channels within a second time segment; and phase information indicating a phase relation between the first and the second original audio channels for the first time segment, wherein the phase information is the only phase information comprised in the representation for the first and for the second time segments.

27. Non-transitory storage medium having stored thereon a computer program comprising a program code for performing, when running on a computer, the method for generating an encoded representation of a first and a second input audio signal, the method comprising:

deriving correlation information indicating a correlation between the first and the second input audio signals;

deriving signal characterization information, the signal characterization information indicating a first or a second, different characteristic of the input audio signals;

deriving phase information when the input audio signals comprise the first characteristic, the phase information indicating a phase relation between the first and the second input audio signals; and including the phase information and a correlation measure into the encoded representation when the input audio signals have the first characteristic; or including the correlation information into the encoded representation when the input audio signals have a second characteristic, wherein the phase information is not included when the input audio signals comprise the second characteristic.

28. Non-transitory storage medium having stored thereon a computer program comprising a program code for performing, when running on a computer, the method for generating an encoded representation of a first and a second input audio signal, the method comprising:

deriving an ICC-parameter or an ILD-parameter, the ICC-parameter indicating a correlation between the first and the second input audio signals, the ILD-parameter indicating a level relation between the first and the second input audio signals;

deriving a phase information, the phase information indicating a phase relation between the first and the second input audio signals;

indicating a first output mode when the phase relation indicates a phase difference between the first and the second input audio signals which is bigger than a predetermined threshold, or indicating a second output mode when the phase difference is smaller than the predetermined threshold; and including the ICC or the ILD parameter and the phase relation into the encoded representation in the first output mode; or including the ICC or the ILD parameter without the phase relation into the encoded representation in the second output mode.

29. Non-transitory storage medium having stored thereon a computer program comprising a program code for performing, when running on a computer, the method for deriving a first and a second audio channel using an encoded representation of an audio signal, the method comprising:

deriving a first intermediate audio signal using a downmix audio signal and first correlation information, the first intermediate audio signal corresponding to a first time segment and comprising a first and a second audio channel;

deriving a second intermediate audio signal using the downmix audio signal and second correlation information, the second intermediate audio signal corresponding to a second time segment and comprising a first and a second audio channel;

deriving a post processed intermediate signal for the first time segment, using the first intermediate audio signal and phase information, wherein the post processed intermediate signal is derived by adding an additional phase shift indicated by a phase relation indicated by the phase information to at least one of the first or the second audio channels of the first intermediate signal; and combining the post processed intermediate signal and the second intermediate audio signal to derive the first and the second audio channels.

30. Non-transitory storage medium of claim 29, wherein the encoded representation comprising the downmix audio signal, the first and second correlation information indicating a correlation between a first and a second original audio channel used to generate the downmix audio signal, the first correlation information comprising the information for the first time segment of the downmix signal and the second correlation information comprising the information for the second, different time segment, the encoded representation further comprising the phase information for the first and the second time segment, the phase information indicating the phase relation between the first and the second original audio channels.

* * * * *